US006887486B2

(12) United States Patent
Gregoire

(10) Patent No.: US 6,887,486 B2
(45) Date of Patent: May 3, 2005

(54) HYDROPHILIC COTTON PAD FOR SKIN CARE COMPRISING TWO DIFFERENT EXTERNAL SURFACES

(75) Inventor: Philippe Gregoire, Les Andelys (FR)

(73) Assignee: Georgia-Pacific France, Kunheim (FR)

( * ) Notice: Subject to any disclaimer, the term of this patent is extended or adjusted under 35 U.S.C. 154(b) by 60 days.

(21) Appl. No.: 10/148,921

(22) PCT Filed: Dec. 5, 2000

(86) PCT No.: PCT/FR00/03395

§ 371 (c)(1),
(2), (4) Date: Jun. 25, 2002

(87) PCT Pub. No.: WO01/42548

PCT Pub. Date: Jun. 14, 2001

(65) Prior Publication Data

US 2003/0104036 A1 Jun. 5, 2003

(30) Foreign Application Priority Data

Dec. 7, 1999 (EP) ..... 99403057

(51) Int. Cl.[7] ..... A61K 9/00
(52) U.S. Cl. ..... 424/400; 424/402; 28/103; 28/104; 442/381; 442/387

(58) Field of Search ..... 424/400, 401, 424/402; 28/103, 104; 442/381, 387, 391

(56) References Cited

U.S. PATENT DOCUMENTS 5,771,517 A * 6/1998 Neveu et al. ..... 8/151
5,849,647 A * 12/1998 Neveu ..... 442/381

* cited by examiner

*Primary Examiner*—James M. Spear
*Assistant Examiner*—Simon J. Oh
(74) *Attorney, Agent, or Firm*—Breiner & Breiner, L.L.C.

(57) ABSTRACT

The invention relates to a hydrophilic cotton pad for skin-care exhibiting a specific surface weight of at least 150 g/m$^2$, and having two different outer sides of which the fibers are entangled.

In the invention, the first outer side has hollow striae apart by a spacing $s_1$ between 1 and 8 mm and having a depth d of at least 0.25 mm and wherein at least 50% of the fibers are entangled.

The pad of the invention is used to apply skin-care products, such as cosmetics, to the skin.

19 Claims, 3 Drawing Sheets

HYDROPHILIC COTTON PAD FOR SKIN CARE COMPRISING TWO DIFFERENT EXTERNAL SURFACES

The present invention relates to a hydrophilic, skin-care cotton pad exhibiting a minimum specific surface weight of 150 g/m$^2$ and having two different outer sides.

Hereafter, the expression "hydrophilic cotton pad" encompasses any product cut into a given format and substantially containing cotton fibers in a proportion of 70 to 100% and synthetic fibers in a proportion of 0 to 30%. Illustratively, the latter fibers are polyolefin-based heat-melting fibers.

Skin-care includes body care, face care, and in particular, care involving cosmetics, namely face make-up and make-up removal, baby care, namely washing and changing the infant, and the like.

Most hydrophilic cotton products or pads on the market are cut into formats, for example, circular (make-up remover disks), oval or square. They frequently are a mixture of cotton fibers of different grades or are a mixture of cotton fibers and other fibers depending on the desired product or the particular manufacturing method. Their composition is homogeneous across their entire thickness and their outer sides are identical in structure and composition. They are symmetrical.

Most often both product sides are used for the same purpose. The surface condition is the same on both sides. Illustratively, one side is arbitrarily used for make-up removal or skin cleansing using a make-up remover or skin lotion and the other side to pick up the product excess without there being a difference in the effectiveness between the two sides. If a cosmetic product such as a lotion or an emulsion is applied to the skin, much of this product will be absorbed by the pad.

Some marketed products for cosmetic use are, fitted with two different outer sides. These are called dual-faced. However, these sides often only differ visually, not inevitably functionally.

A first pad (D) includes a lap consisting of superposed external webs and this lap in turn is sandwiched between two previously calendered outer non-woven plies. The combination of these plies may be implemented adhesively. The two external plies may be made different from each other by varying the calendering and, if called for, by imprinting different patterns on each side.

Another pad (E) also consists of a lap of superposed non-woven plies on which is deposited a hydro-entangled non-woven prior to cutting.

When these webs are 100% cotton fiber, the hydro-entangled non-woven is a mixture of artificial and synthetic fibers and more specifically of viscose and polyester.

The nature of the surface non-woven therefore is different from the central lap in the case just above.

Other two-sided products have been described in the prior art.

In the field of non-wovens for example, European Patent Application No. 0 750 062 describes skin-cleansing articles which are both soft to the skin and sufficiently strong to rub the skin with them without irritation or lesions. Rubbing allows removing impurities and dead cells from the skin surface. These articles include a preferably hydro-entangled non-woven substrate which exhibits a specific surface weight between 20 and 150 g/m$^2$ and which is characterized by a specific coefficient of friction. Preferably the substrate includes at least some long fibers which are able to extricate themselves from the main surface on account of friction while remaining attached to the substrate. The substrate may consist of a mixture of hydrophilic and hydrophobic fibers or solely of hydrophilic or hydrophobic fibers. At least one side of such a substrate implements mostly skin cleansing. It also acts as a support for cleansing products or make-up removers such as lotions. In the event the skin-cleaning article has two different sides, the non-woven substrate is combined with other layers made of different material. If the cleansing article only consists of the non-woven substrate, the two sides are identical and hence are not differentiated from each other. In that case, the article will be akin to a dry tissue of which the two sides can be used arbitrarily for skin cleansing.

French Patent No. 2,052,089 describes a plain cotton or a surgical cotton element consisting of at least two layers of different grades and joined to each other by stuffing or by compression while remaining soft and bulky when in contact with the skin. One of the sides is specifically intended for pre-removal of make-up and the other for the final removal of make-up. In this design the two sides are different in the kind or grade of the two layers. They may be different or made of the same materials but of different grades. This is a composite product.

In its French Patent Application No. 99 07612 (not yet published), applicant describes a product including 100% hydrophilic cotton and having at least a first and a second external layer, the first layer being of fine fibers of a low micronaire index and the second layer being of fibers of a higher micronaire index constituting a so-called "scratching" cleansing side. The sides differ by the nature of the cotton fibers.

The object of European Patent Application No. 0 405 043 is a pad with which to apply and/or remove liquid or semi-solid substances and which has at least three superposed layers made of a fibrous, absorbing material such as cotton. Each of the two outer layers is compressed by pressure being applied uniformly to the whole layer surface and may include additional compression zones due to imprinting a pattern. The central layer is uncompressed and constitutes the absorbing core of the pad. The three layers are superposed to subtend a sandwich structure. The two outer sides may have different patterns and may be compressed more or less. This product is designed to apply a cream or a liquid but is too weak for make-up removal or skin cleansing. Frictional forces are exerted on the skin by the pad which furthermore supports a wetting substance on its surface. Also, the cohesion between the layers is insufficient on account of the sandwich structure of this design. There are three superposed and distinct layers connected at their rims.

In light of the above state of the art, there is no extant "thick" hydrophilic product or pad at present that exhibits a specific surface weight of at least 150 g/m$^2$ and is strong enough to efficiently cleanse the skin without irritation and has two different outer sides exhibiting different features and properties.

Therefore, it is an object of the present invention to provide a pad of which the two outer sides are mutually different without modifying either the nature of the cotton fibers or the quality of the cotton layers, differentiation taking place solely not only at the pad's surfaces but also for one of the sides within the pad thickness.

Another object of the invention is to provide a strong pad of good cohesion.

Yet another object of the present invention is a hydrophilic cotton pad exhibiting a specific surface weight of at least 150 g/m$^2$ and including two distinct sides, one for skin-care, in particular skin cleansing and applying make-up and/or make-up removal cosmetics, while the other side is softer and more absorbing and is used to absorb the surplus of an applied product.

As regards make-up removal, the pad should optimize cleansing efficiency when using make-up removing products, namely a single motion on the skin should suffice, in particular when using that side of the pad which is designed for such a purpose.

The user can tell during use which side is which, namely by the sense of touch, or by contact with the skin, or by applying skin-care products to the skin, and also visually.

Another object of the invention is to provide a pad of which the skin-care side accepts aqueous cosmetics while retarding their absorption and their penetration into the pad.

Yet another object of the invention is to create simple pad manufacturing procedures while circumventing composite cotton laps of complex structures.

The object of the present invention is a hydrophilic cotton pad used for skin-care and exhibiting a minimum specific surface weight of 150 g/m$^2$ and including two different outer sides of which the fibers are linked.

In an essential feature of the present invention, the first outer side includes hollow striae which are mutually apart by a spacing $s_1$ from 1 to 8 mm and are of a depth d of at least 0.25 mm, and the tensile strength of the pad is at least 20 N in the direction of motion and at least 16 N in the direction transverse thereto as determined by a test further described below.

In another essential feature of the present invention, the first outer side includes hollow striae which are mutually apart by a spacing $s_1$ between 1 and 8 mm and are of a depth d of at least 0.25 mm and wherein at least 50% of the fibers are entangled.

In one advantageous feature of the invention, the spacing $s_1$ between the striae of the first side is between 1.2 mm and 5.5 mm and preferably between 2 and 4 mm.

In a preferred embodiment of the present invention, the depth d of the striae of the first side is at least 0.40 mm and preferably at least 0.50 mm.

In another feature of the invention, at least 60% of the pad fibers are entangled.

In order to raise the efficiency of applying to the skin such aqueous products as cosmetics, or of cleansing the skin using aqueous make-up removal products, the first outer pad surface includes an agent for retarding the absorption of aqueous products.

The invention also relates to methods for manufacturing the hydrophilic cotton pad of the invention.

A first method involves providing a cotton lap, hydroentangling a first outer side of the lap by using water jets of mutually spaced apart axes by a spacing between 1 and 5.5 mm and with an applied energy density of at least $1.4\times10^{-3}$ kwh/m$^2$, and hydroentangling the outer side of the lap using water jets of which the axes are mutually apart by a spacing between 0.4 and 1.2 mm at an applied energy density of at least $0.9\times10^{-3}$ kwh/m$^2$.

A second method involves providing at least two laps of hydrophilic cotton based on bleached fibers configured into laps or into bleached laps, marking the first lap in a manner to imprint striae mutually apart between 1 and 8 mm and exhibiting a depth of at least 0.25 mm at one outer side of the first lap, the imprint pressure being sufficient to attain a pad strength in the direction of motion of at least 20 N and of at least 16 N in the direction transverse thereto as measured in a procedure described further below, in marking or consolidating the second lap and in combining the two laps so made, the two marked and/or consolidated laps being configured on the outside of the pad.

Other features and advantages of the invention are elucidated in the description below and in relation to the attached drawings.

Figure 1:
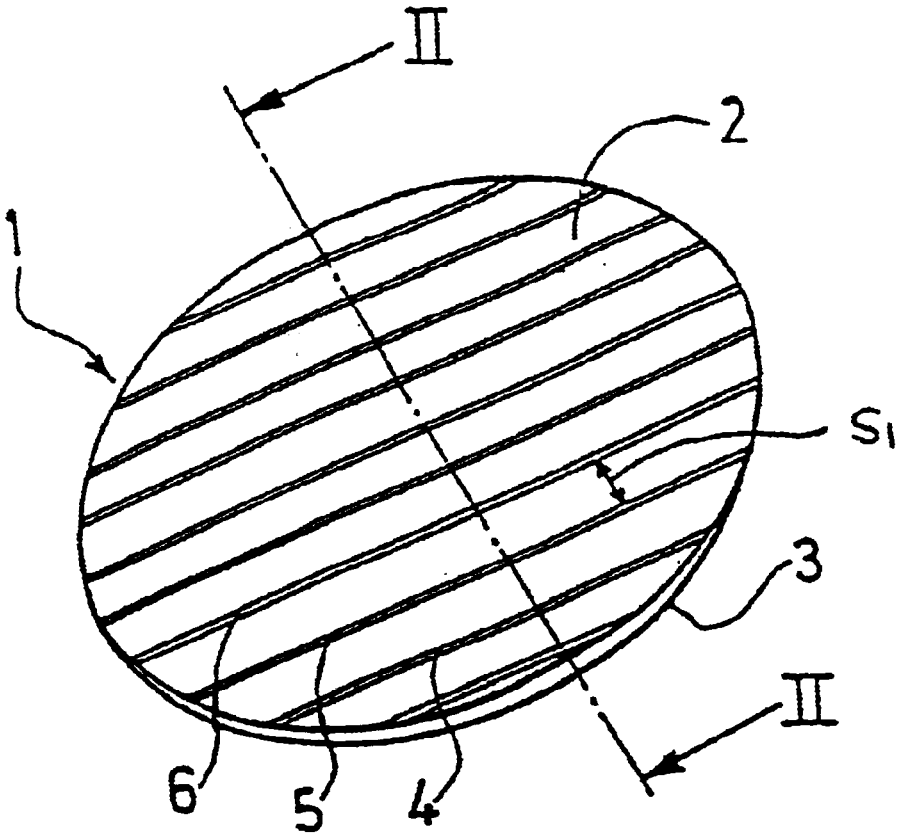
FIG. 1 is a perspective of a pad of the invention.
Figure 2:
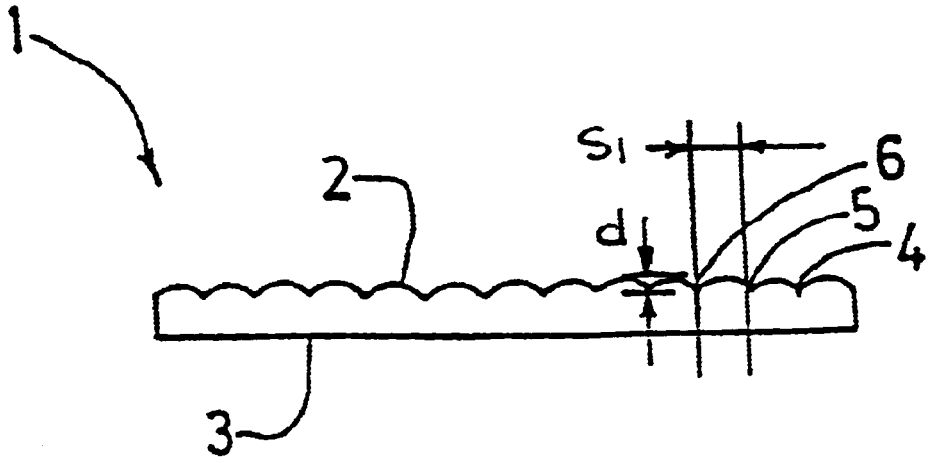
FIG. 2 is a schematic cross-section along line II—II of the pad shown in FIG. 1.
Figure 3A:
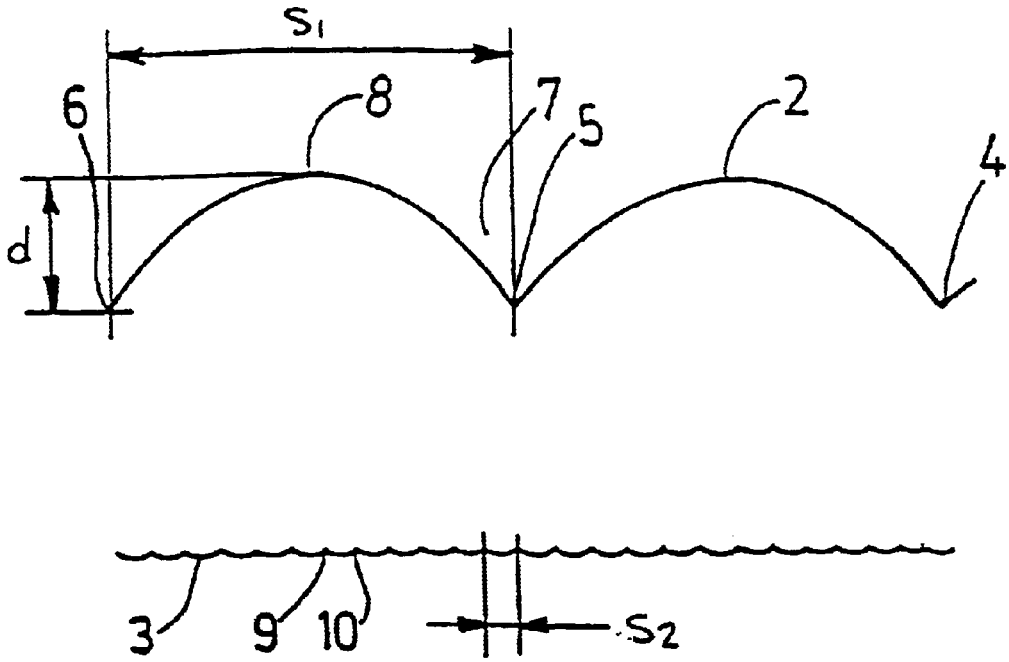
FIG. 3A is an enlarged view of the pad shown in FIG. 2 in the vicinity of a stria and corresponds to the hydroentangling procedure.
Figure 3B:
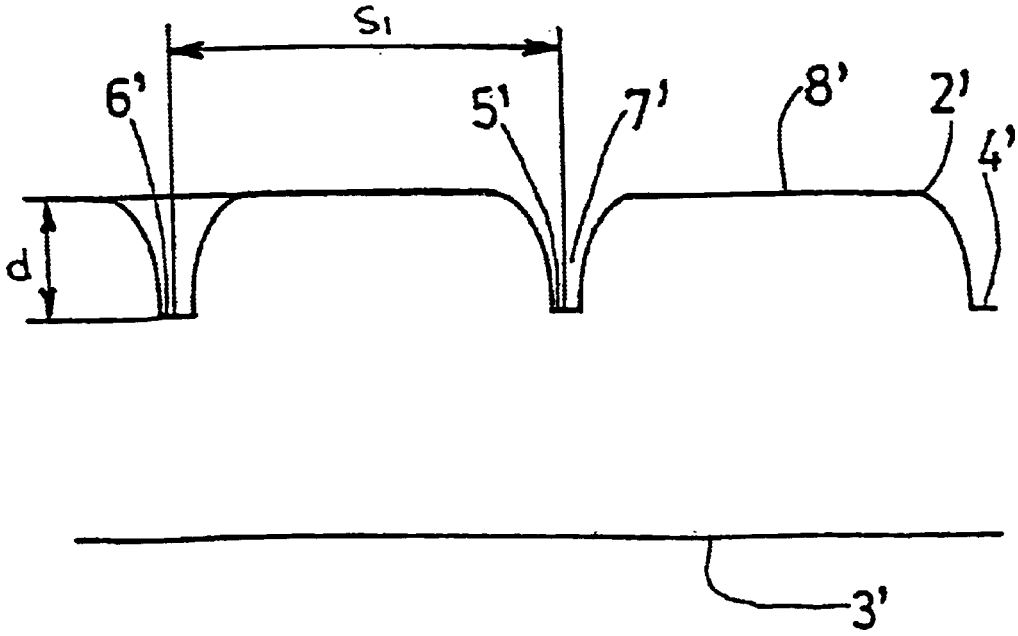
FIG. 3B is an enlargement of a pad of another embodiment using the marking technique.

The pad of the invention is a round, oval, square cutout, or any other shape. Its specific surface weight is between 150 and 400 g/m$^2$, preferably between 180 and 300 g/m$^2$. It is based on cotton and essentially comprises absorbing hydrophilic cotton fibers. More specifically, it contains 70 to 100% homogeneous cotton fibers and 0 to 30% artificial fibers such as those of viscose, of synthetic fibers such as of polyester, binary fibers (polyester/polyester, polypropylene/polypropylene or polyester/polypropylene), or mixtures thereof.

The pad comprises one lap composed of one or more layer(s) constituted of cotton fibers. The pad also can comprise two superposed layers each constituted of a cotton lap. The pad also can comprise three layers, a central one of a lap of cotton fibers and two outer ones, illustratively, of cotton webs and enclosing the central layer.

In the pad's embodiments shown in FIGS. 1 through 3B, the pad 1 comprises a first outer side 2, 2' and a second outer side 3, 3'. The first outer side 2, 2' comprises striae 4, 4'; 5, 5' and 6, 6' which in this instance run parallel to each other. The spacings $s_1$ between the striae is between 1 and 8 mm, preferably between 1.2 and 5.5 mm and in particular between 2 and 4 mm. The stria depth d is at least 0.25 mm, preferably at least 0.50 mm. The striae subtend troughs 7, 7' and peaks 8, 8' which are visible to the naked eye. The second outer side 3, 3' also is fitted with striae 9 and 10 which are much finer and closer to each other. The spacing $s_2$ between the striae of this second surface is between 0.4 and 1.2 mm.

The stria depth is less at the second side than on the first. In some pad designs, it will be about 0.1 mm.

FIGS. 4A, 4B, 4C and 4D illustrate other embodiments of the pad of the invention.

Figure 4A:
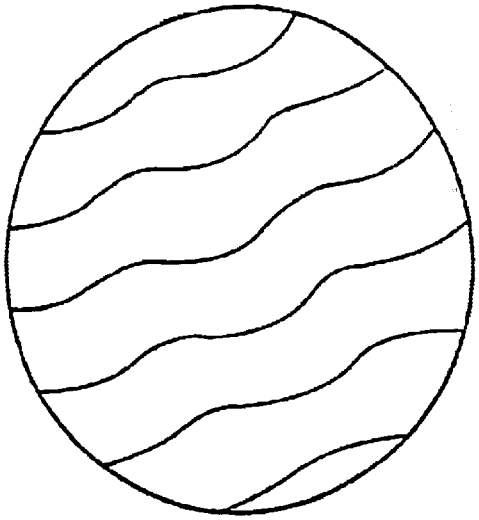
FIGS. 4A, 4B, 4C, 4D represent different surface conditions illustrating pads of the invention.
Figure 4B:
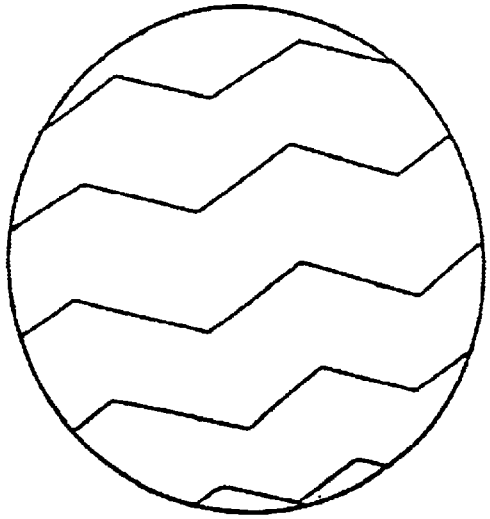
Figure 4C:
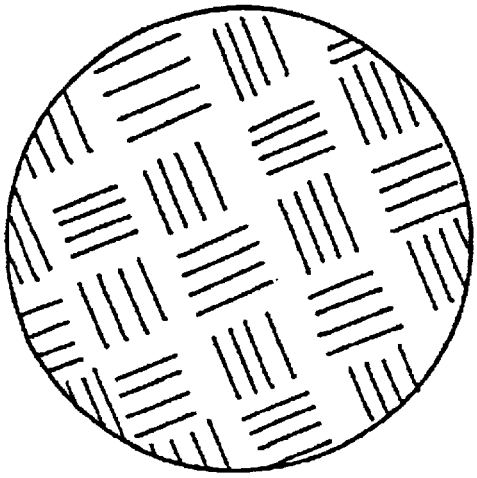

At the surface of the first outer side 2, 2', the stria can constitute uninterrupted lines as in FIGS. 1, 4A and 4B, or isolated lines as in FIG. 4C, straight lines as in FIG. 1, curved lines as in FIG. 4A or mathematically discontinuous lines as in FIG. 4B. No matter how they are configured and distributed, or whatever their geometries, it is important that the striae's comprise a number of peaks and troughs at the first pad side.

The pad of the invention offers another essential feature, namely especially high tensile strength both in the direction of motion and in the transverse direction thereto as compared to that of known products. Because of this strength, the pad will not warp when being used.

In the description below, the tensile strength is that measured on a test specimen and in the manner elucidated below.

Samples 57 mm long and 25 mm wide are cut from the pads of the invention. A first set of samples is cut out in a way to secure the greatest sample length in the direction of motion for the purpose of measuring its strength in that direction. A second set of samples is cut out to attain the greatest sample length in the transverse direction to test its strength transversely.

Tensile strength is measured using a dynamometer.

Tensile strength of the pads of the invention is measured in the manner now explained. The sample is placed between two jaws 30 mm apart in the length direction of the sample. The jaws are moved apart at a rate of 100 mm/min and the maximum force exerted before rupture is measured. This maximum force is the tensile strength.

Tensile strength is measured on the following pads:

Pads A of the invention consisting 100% of cotton fibers,

Pads B also consisting 100% of cotton fibers and manufactured by applicant based on laps described in European Patent No. 0 681 621 and marketed under the name of LOTUS®, Pads C consisting 100% of cotton fibers from laps manufactured according to European Patent Application No. 0 735 175 and marketed under the name DEMAK'UP®, Pads D consisting 100% of cotton fibers and comprising an uncompressed central lap and two marked and calendered webs enclosing the central lap, Pads E consisting of a lap itself made up of superposed webs, a hydroentangled non-woven of viscose and polyester fibers being deposited before cutout on the lap, and Pads F consisting of 15% heat-melting fibers and 85% cotton fibers, the layers being alike and lacking surface patterns.

The pads B, C, D, E and F are those of the state of the art. The mean test results are listed in the Table below.

| | A | B | C | D | E | F |
|---|---|---|---|---|---|---|
| Tensile strength in direction of motion (N) | 25 | 10 | 11 | 10 | 13 | 9 |
| Tensile strength in transverse direction (N) | 20 | 4 | 6 | 4 | 4 | 4 |

The tensile strength in the direction of motion and in the transverse direction exhibited by the pads of the invention, i.e. pads A, much exceed those of the pads B, C, D, E and F. In use, such strength is reflected by the pad's lack of warping.

The pads of the invention exhibit a tensile strength of at least 20 Newtons in the direction of motion and at least 15 Newtons in the transverse direction thereto.

Be it also borne in mind that the tensile strength in the transverse direction exhibited by pads A of the invention approaches that of the tensile strength in the direction of motion. The product of the invention is homogeneous and advantageously offers some symmetry between tensile strength and warping on one hand and on the other as regards the two directions. This product is dubbed "square".

Elongation when subjected to a force of 5 Newtons also was measured using the same material as was used for the tensile strength tests.

The percentage test results shown in the Table below are for the direction of motion.

| | A | B | C | D | E | F |
|---|---|---|---|---|---|---|
| Elongation at 5 N (%) | 1.42 | 3.16 | 1.84 | 6.4 | 3.9 | 0.98 |

The less the elongation, the less the pad's warping.

Be it borne in mind that, as regards the pads consisting 100% of cotton fibers, the least elongation takes place in the pads of the invention.

Still another essential feature of the pad is the percentage of entangled fibers compared with known hydrophilic cotton pads.

As regards the pads of the invention, at least 50%, and preferably at least 60%, of the fibers are entangled.

In order to illustrate the quantity of entangled fibers, the weight of entangled fibers was measured at the pad surface by the technique described below.

The test samples are disk-shaped pads about 57 mm in diameter. That part of the disk corresponding to the entangled fibers is carefully separated by manually removing the free fibers which do not impede this removal. Then the remaining disk part is measured. The measured weight corresponds to the entangled fibers quantity.

Tests were run on pads A, B, C, D and E.

The test results are shown in the Table below.

| | A | B | C | D | E |
|---|---|---|---|---|---|
| Weight of entangled fibers (g) | 0.37 | 0.15 | 0.13 | 0.05–0.08 | 0.09 |
| Related specific surface weight | 150 | 61 | 52 | 20–30 | 37 |

The quantity of entangled fibers in the pad of the invention is larger by a factor of 2, even 3, relative to the case of the quantity of entangled fibers of the pads of the state of the art. As regards the first side, the surface fibers are affixed at least at one point within the pad's thickness. In this manner the first pad side can be structured and a permanent topography imparted to it.

This feature is a surprising result and endows the lap with excellent cohesion.

The cohesion of the pad of the invention is clearly improved over that of the pads of the state of the art.

In order to show such cohesion, the delamination strength of pads A of the invention as well as that of pads B, C, D and E of the state of the art was measured. All these pads are disks about 57 mm in diameter.

Delamination strength is measured as follows:

the same equipment as in the tensile strength tests was used, though the jaws were replaced by plates, a tape with adhesive on both sides is placed on each plate, the cotton disk is directly placed on the adhesive of the lower plate, the two plates are mutually compressed, the two plates are moved apart at a rate of 100 mm/min as far as a distance of 30 mm, and the maximum force required to delaminate the disk is measured.

The Table below lists the test results.

| | A | B | C | D | E | F |
|---|---|---|---|---|---|---|
| Delamination strength (N) | 0.73 | 0.62 | 0.55 | 0.49 | 0.01 | 0.74 |

The Table shows a clear improvement in delamination strength in the pads of the invention consisting 100% of cotton fibers over that of pads B, C, D and E of the state of the art which consist 100% of cotton fibers. Pads A of the invention in this instance consist 100% of cotton fibers and offer a delamination strength similar to that of a product (pad F) consisting 15% of heat-melting fibers and 85% of cotton fibers.

As regards pad E, the adhesion between the lap of webs and the hydroentangled lap is especially weak.

The first side of the pad of the invention is much freer of fluff than some known products.

The fluffing strength was measured at the first side of pad A of the invention and of pads B, C, D, E and F of the state of the art using a particular procedure elucidated below. The pads are discoid and their diameter is about 57 mm.

This procedure uses a rubber stub mounted on a cylinder to simulate rubbing the skin. This stub is driven into motion so as to rest on its surface and then move on it. The washer-shaped pad is placed on a plate of which the surface is clad with TEFLON. Then the pad is fixed in place by another plate being superposed on it, the latter plate exhibiting a U cutout to allow passing the stub, the cutout baring part of the pad. The number of stub passes is adjusted, also the speed, and a counterweight applied to the stub sets its load.

During testing, the stub is deposited and then moved five consecutive times on the pad surface. Fibers then will detach from the pad surface and will accumulate on the stub. Following the five passes, the fibers retained by the stub are recovered using tweezers and these recovered fibers then are placed on a watch glass. This procedure is repeated for 5 pads of each of the types A, B, C, D, E and F. The fibers so recovered from five pads are weighed on a balance sensitive to one tenth of a mg. Each kind of pad A, B, C, D, E and F was tested.

As regards the A pads, both the first outer side A1 and the second outer side A2 were tested.

As regards the E pads, the side corresponding to the hydroentangled web E1 as well as the other side E2 were tested.

The mean weights are shown in the Table below.

| | A1 | A2 | B | C | D | E1 | E2 | F |
|---|---|---|---|---|---|---|---|---|
| Weight of extracted fibers ($10^{-4}$ g) | 5 | 50 | 50 | 50 | 30 | 3.5 | 480 | 55 |

Relative to the measured weight of the pads B, C, D and F, the weight of the fibers of the first side of the pads of the invention is one-tenth. Pad E exhibits one hardly fluffy surface because of the presence of the non-woven, but it also exhibits another excessively fluffy side compared to the second side of the pad of the invention. The lowering of fluffiness is therefore substantial for the pad of the invention. The weight of the discoid cotton pads presently in use varies between 0.5 and 0.7 g. The fibers extracted from the first side (A1) of the five A pads of the invention therefore correspond to 0.1% of the weight of pad A. By comparison, the fibers extracted from the five pads each time of the B, C, D and F types of the state of the art amount to 1% of the weight of the corresponding pads.

This result is unexpected and very advantageous.

Accordingly, the first side of the pad exhibits a new structure offering advantageous properties.

Actually the pad of the invention offers many practical advantages.

The first side is used to apply skin-care products to the skin.

In case the skin is cleansed or its make-up is removed, this cosmetic is applied to the first pad side which next is moved over the skin or the face.

A single pad pass is sufficient, rubbing is superfluous. As a consequence skin irritation is avoided.

The stria-fitted first side structure advantageously subtends a troughs-and-peaks topography. The area making contact with the skin is relatively limited on account of the topography.

The topography's salients increase the pressure applied to the skin and rubbing. The rubbing effect so attained improves cleansing. The troughs act as additional stores of the available product.

When the pad is moved over the skin, the troughs first fill with and act as storage devices for the product which will spread when the pad makes contact with the skin on account of the application pressure, and thereafter the troughs act as impurity collecting devices as the pad is moved over the skin. The cleansing implemented by the first pass therefore is optimized.

When the stria are arrayed in a mutually parallel manner, the pad preferably is moved on the skin perpendicularly to the striae of the first side.

The second side is used to absorb impurities, excess product and make-up remnants on the skin.

The product when being used will not warp and allows for excellent gripping.

In a particular application, namely that of nail varnish removal, the solvent, which conventionally penetrates the pad, enters it less in depth and is more easily returned during cleansing thanks to the more compact geometry of the first pad side and to the fibers tightened within the pad's thickness. In this way the solvent is used more efficiently to dissolve the varnish on the nails.

Another effect was found by the persons testing the pad of the invention.

The topography of the first side in contact with the skin provides a massaging effect due to the pad motion and relaxes the skin.

In order to improve on the use of aqueous skin-care products such as toiletry products, make-up and make-up removing products, the first outer side can include an agent retarding the absorption of such products and thus allows temporarily keeping the applied products at the pad's surface, i.e. without immediately penetrating inside the pad.

Combining the structure of the above described first side with this new property of absorption retardation of aqueous products leads to a high performance product.

The absorption retarding agent is based on softeners or waxes or also a component adhering to the fibers.

Such absorption retarding agents when applied in small doses to conventionally hydrophilic and absorbing cotton products surprisingly retards the absorption of aqueous products at the surface of cotton products.

Softeners for example include fatty amines, fatty acids, fatty alcohols, fatty esters, fatty polyethylenes or polyamides or their mixtures.

Components adhering to the fibers illustratively are complex metal salts of stearic acid, perfluorinated derivatives, zirconium salts and also silicones.

The wax-based components are wax and paraffin emulsions or wax emulsions alone.

Preferably the agent is an emulsion of a natural wax, of mineral, vegetal or animal origin.

Illustratively animal waxes are spermacetic wax and beeswax.

Illustrative vegetal waxes are carnauba wax and candelilla wax.

Ceresin and azocerite are examples of mineral waxes.

The emulsion of beeswax is especially advantageous and appropriate for the cosmetic application of the pad. This component has been tested dermatologically. It is a cation emulsion of bleached beeswax containing beeswax, water, emulsifiers, glyceryl stearate and diethanolaminoether stearate.

Beeswax per se is composed of esters of wax fatty acids such as myricyl palmitate, cerotic acid and other homologous waxy acids and small quantities of hydrocarbons, cholesterol esters and cerylic alcohols.

The retarding agent is an emulsion or dispersion containing at least 30% active ingredient.

The first side of the product or pad of the invention contains at least 1 $g/m^2$ of applied emulsion, that is at least 0.3 $g/m^2$ of deposited active ingredients.

The first side fitted at its surface with such a retarding agent offers highly advantageous properties.

It delays penetration by aqueous products applied into the pad's surface.

Penetration by skin-care products such as skin lotions, make-up removers etc. is a major drawback of conventional hydrophilic cotton pads. Skin-care or cosmetic products are wasted or used uneconomically, and sometimes they pass through the pad. Skin cleansing remains less than optimal.

Using the processing of the invention for the first pad side, temporary water impermeability is created and allows quasi-spontaneous absorption of aqueous products in the hydrophilic cotton fibers as soon as they are deposited on the pad.

A simple test showing there is such a property consists in depositing on one hand pads of the invention processed in said manner, at the surface of a water filled receptacle and at ambient temperature (about 20° C.), the processed surface facing outward and the absorbent surface toward the water, and on the other hand conventional B and C pads. The pads of the invention remain at the water surface at least 5 minutes, whereas those of the state of the art almost at once impregnate with water and immerse very quickly into it, in general after 3 to 5 seconds.

The advantage offered by the invention therefore is to keep the products at the surface longer and to make use of all the product deposited on the pad for skin-care, without loss of product or without warping this pad.

An in-house test run at applicant's premises involved 25 persons usually using C pads exclusively made of hydrophilic cotton for skin-care, make-up removal etc.

Pads A of the invention of which the first side was processed with an absorption-retarding agent were compared with pads of the invention of which the first side was unprocessed and with pads C of the state of the art.

The following observations were made.

As regards the pads of the invention of which the first side was unprocessed, 50% of the persons noted a delay in absorption of the skin-care products deposited on the surface of these pads. This feature is attributed to the specific structure of the first side of the pads of the invention, the fibers being packed more tightly within the pad's thickness.

As regards the pads of the invention of which the first side was processed, a near totality of the persons, namely 92%, observed the pad's retardation of skin-care product absorption delay.

Also 50% of these persons noted improvement in skin cleansing using the pads of the invention when the first side was unprocessed. As regards the pads of the invention of which the first side was processed, the number of persons noting an improvement in cleansing was 92%.

Lastly and as regards make-up removal, 50% of the persons noted improved make-up removal when using the pads of the invention of which the first side had been left unprocessed. Improved make-up removal was noted by 85% for those pads of the invention of which the first side had been processed.

Similar advantages were noted when using make-up products such as lotions, creams, make-up bases, rouge, when applying and spreading the product on the skin.

These persons also advantageously used the product of the invention when applying perfumes such as toilet waters. The immediate absorption of such toilet waters into the pad is averted in comparison with such an application to the cotton products of the prior state of the art.

Two manufacturing methods are available for the pad of the invention.

A first technique involves differentiating between the two pad sides by hydroentangling each of the sides according to different parameters.

A first procedure involves lapping at least two cotton fiber laps constituting the two outer layers. These laps can be made of the same or of different fiber qualities. They can be made directly from bleached and hydrophilic cotton. They also can be made from raw and ecru cotton and then are chemically processed to attain the hydrophilic and bleached properties. They are then superposed and combined by any known means, adhesively or mechanically, such as calendering or needling. Also the combination can be implemented hydraulically.

Good combination also can be attained by conventionally impregnating the superposed laps, for example by immersion into an impregnation bath, by atomization, by pouring a solution. Such impregnation is combined with squeeze compacting the lap and eliminating part of the liquid it previously contained, for example by calendaring or passing through a vacuum slot.

A second technique involves preparing a lap of cotton fibers pneumatically and in configuring this lap between two cotton webs. One procedure continuously manufacturing and combining webs is described in applicant's European Patent No. 0 681 621.

In the latter case, the impregnation of the lap enclosed by the two webs and implemented during the various chemical processing procedures contributes to combining the layers.

Hydroentangling allows both combining the layers and the two laps and to link the surfaces of the lap. Specific hydroentangling parameters are selected for the first outer side and more conventional hydroentangling parameters are used for the other side. As a result, a single technique allows carrying out three different functions: combining the layers or laps, entangling the fibers and differentiating the two outer sides. Hydroentangling is implemented by high pressure water jets in combination with vacuum expression using equipment marketed by ICBT-PERFOJET at Grenoble, France.

In the case of an ecru fiber to be treated chemically, the two hydroentangling stages for processing each of the product's outer sides can take place immediately following the lap impregnation stage in the manner described in European Patent Application No. 0 735 175. The two hydroentangling stages also can be scheduled for the final rinsing stage as disclosed in applicant's European Patent No. 0 805 888. The advantage offered by either procedure is to directly differentiate in-line the two sides by hydroentangling.

The two outer sides are hydroentangled according to different parameters on endless cloths or on cylinders.

The high pressure water jets used to entangle the outer side fibers mark the surfaces of these sides with striae visible to the naked eye. More specifically, the hydroentangling equipment comprises a high pressure pump feeding an injector configured transversely to the path of the lap across its full width. The injector subtends a pressurized volume of water closed by a steel strip perforated with gauge holes generating jets in the form of high pressure, fine water needles pointing orthogonally to the outer side surface. These fine jets entangle the fibers and drive the free surface fibers into the product's thickness.

By varying the distance between the axes of the holes and the hole diameters and by selecting a particular applied energy for a given hydroentangling equipment processing one outer side relative to the other equipment processing the other outer side, the two outer product sides will be differentiated.

Illustratively as regards the first outer side, hydroentangling equipment can be used of which the strip perforations are much apart, namely from 1 to 5.5 mm and preferably between 2 and 4 mm. The strip perforations exhibit diameters between 130 and 200 $\mu$m, preferably between 140 and 170 $\mu$m, and are arrayed regularly. If the injector position is fixed and the cotton layers move underneath it, the product surface exhibits a series of parallel striae or grooves corresponding to the motion underneath the jets. The applied pressure is high, at least 40 bars and preferably is between 50 and 80 bars in order to impart depth to the striae. These striae are the result of compressing, driving and affixing the fibers in the lap's thickness. In order to implement the striae, the energy applied is at least $1.4\times10^{-3}$ kwh/m$^2$ and can vary between $1.4\times10^{-3}$ and $2.5\times10^{-3}$ kwh/m$^2$ depending on speed, pressure, diameter of perforations and distance between them.

By varying the injector position or by displacing or causing the strip to vibrate, different striae geometries can be attained (for example FIG. 4A). Moreover, masks can be placed underneath the strip to close certain perforations into a specific geometry in order to configure the striae in the manner shown in FIG. 4C.

The first side which was hydroentangled in this manner offers a compact, "highly structured" appearance, namely a peaks-and-troughs topography. The surface grade so attained will not fluff at all.

Hydroentangling equipment implementing conventional parameters is used for the second outer side and comprises a strip perforated by holes mutually apart by 0.4 to 1.2 mm, preferably between 0.4 and 0.9 mm. The hole diameter can range from 100 to 130 $\mu$m.

The applied pressures used at speeds similar to those used in processing the first side are moderate, namely from 20 to 40 bars. The corresponding applied energy is then between $0.9\times10^{-3}$ and $1.6\times10^{-3}$ kwh/m$^2$.

The stria made in the second side are much finer and also are shallow. The second outer side looks less compacted, with a soft and absorbing surface. It lacks a topography visible to the naked eye.

The two sides so made look basically different.

Additional differentiation can be introduced by impressing markings of different patterns from those of the extant striae on the first side.

A second method for manufacturing the pad of the invention differentiates the two pad sides by markings.

Two laps are prepared from bleached fibers which are congregated into laps or bleached laps. Next they are each marked by being made to pass between an engraved cylinder with a pattern in the form of peaks and troughs and a smooth mating part and in this manner the pattern is impressed into the lap's thickness and constitutes a peaks-and-troughs pattern of relative depths at the surface of the laps which correspond to the pad's outer sides. The marking pressures exerted by the cylinders suffice to attain the expected pad strengths, that is, at least 20 N in the direction of motion and at least 16 N transversely thereto as measured in the above test procedure.

The laps can contain heat-melting, synthetic fibers. They are compressed using heated calenders, whereby the fibers are linked by the melting heat-melting fibers, and cohesion is improved.

The first lap can be marked using a cylinder illustratively comprising mutually parallel salient bands perpendicular to the cylinder's axis and shaping parallel striae in the product surface, the strips being apart by 1 to 8 mm, preferably 2 to 4 mm. The height of the bands corresponding to the stria depths is at least 0.25 mm and preferably at least 0.50 mm.

The second side can be marked using a cylinder illustratively comprising mutually parallel salient bands perpendicular to the cylinder axes and mutually apart by 0.8 to 1.2 mm. The band height is less than 0.25 mm.

By means of marking, arbitrary geometries and distribution of the striae can be considered, in particular with respect to the first lap's surface in order to constitute a peaks-and-troughs topography on the first side.

Figure 4D:
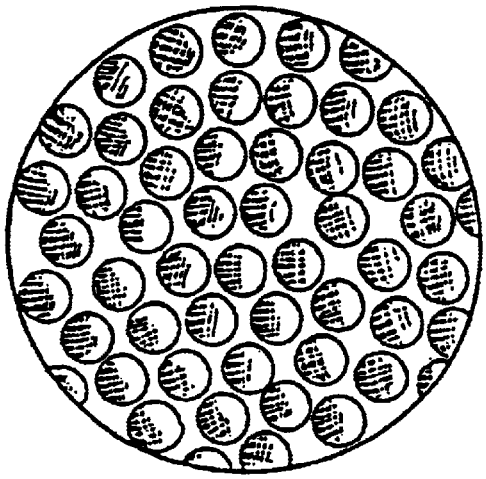

FIG. 4D shows an illustrative marking pattern. The circles corresponding to the imprinted pattern constitute hollows at the pad surface.

In another embodiment, the second side can be calendered in the absence of a marking pattern or it can be consolidated by any known means such as hydroentangling, binder atomization, heating any heat-melting fibers.

The two laps thusly marked and/or combined are superposed in such a way that the marked and/or combined surfaces are situated externally. Illustratively they are combined by adhesion using starch.

When the product that becomes the pad of the invention is being manufactured, the first outer side is processed to retard the absorption of the aqueous products (skin-care products and the like) for purposes of cosmetic pad use.

Following the impregnation stages but before or after drying, the first side is processed by applying to it an agent retarding aqueous product absorption as described above. Illustratively, a wax emulsion is applied at a rate of at least 1 g/m$^2$, so that at least 0.3 g/m$^2$ of active ingredient (wax) is deposited.

This surface processing is carried out in any conventional manner such as atomization through nozzles, coating using a cylinder, rotogravure printing and the like.

Having different sides, the products so made then are cut to format and packed in flexible pouches.

Be it borne in mind that on account of the novel structure of the first pad side and its surface condition, the stacked pads are more easily isolated from each other. It is much easier to extract them one after the other from their package once the package aperture has been opened.

What is claimed is:

1. A hydrophilic cotton pad used for skin-care having a specific surface weight of at least 150 g/m$^2$, comprising a first outer side and a second outer side which are different from each other and which each have fibers which are entangled, wherein the first outer side comprises hollow striae spaced apart by a spacing $s_1$ of between 1 and 8 mm and have a stria depth d of at least 0.25 mm, and wherein the pad has a tensile strength of at least 20 N in a direction of motion and at least 16 N in a direction transverse thereto.

2. A hydrophilic cotton pad for skin-care having a specific surface weight of at least 150 g/m$^2$, comprising a first outer side and a second outer side which are different from each other and which each have fibers which are entangled, wherein the first outer side comprises hollow striae spaced apart by a spacing $s_1$ of between 1 and 8 mm and have a depth d of at least 0.25 mm, and wherein at least 50% of the fibers are entangled.

3. Pad as claimed in claim 1 or 2, wherein the spacing $s_1$ between the striae of the first outer side is between 1.2 and 5.5 mm.

4. Pad as claimed in claim 1 or 2, wherein the stria depth d of the first outer side is at least 0.40 mm.

5. Pad as claimed in claim 1 or 2, wherein the tensile strength is at least 25 N in the direction of motion and at least 20 N in the direction transverse thereto.

6. Pad as claimed in claim 1 or 2, wherein the second outer side comprises striae which are spaced apart by a spacing $s_2$ of between 0.4 and 1.2 mm.

7. Pad as claimed in claim 1 or 2, wherein at least 60% of the fibers are entangled.

8. Pad as claimed in claim 1 or 2, wherein the striae of the first outer side are continuous, discontinuous, or curved lines.

9. Pad as claimed in claim 1 or 2, wherein the fibers are 100% cotton fibers.

10. Pad as claimed in claim 1 or 2, wherein one of the first outer side or the second outer side comprises an imprint distinct from the striae.

11. Pad as claimed in claim 1 or 2, wherein the first outer side includes an absorption retarding agent for aqueous products.

12. Pad as claimed in claim 11, wherein the retarding agent is a composition based on a softener, or wax.

13. Pad as claimed in claim 12, wherein the retarding agent is an emulsion of a natural wax, mineral-based wax, vegetal-based wax or an animal-based wax.

14. Pad as claimed in claim 13, wherein the wax emulsion is a beeswax emulsion.

15. A method for manufacturing a hydrophilic cotton pad as claimed in claim 1 or 2, wherein said method comprises providing a cotton lap, hydroentangling the first outer side of said lap using water jets having axes which are spaced apart by a spacing of between 1 and 5.5 mm and which have an applied energy of at least $1.4\times10^{-3}$ kwh/m$^2$, and hydroentangling the second outer side of the lap using water jets having axes spaced apart by a spacing of between 0.4 and 1.2 mm and which have an applied energy of at least 0.9×10−3 kwh/m$^2$.

16. A manufacturing method for a pad as claimed in claim 1 or 2, wherein said method comprises providing at least two hydrophilic cotton laps based on bleached fibers conformed into laps or bleached laps, marking a first lap such that striae are formed spaced apart from each other by 1 to 8 mm and are at least 0.25 mm deep, wherein marking pressure is sufficient to impart to the pad a strength of at least 20 N in a direction of motion and 16 N in a direction transverse thereto, marking or consolidating the second lap, and combining the first lap and the second lap so processed wherein each side which has been marked and/or consolidated is situated at an outside of the pad.

17. Method for manufacturing a pad as claimed in claim 15, further comprising applying an agent for retarding absorption of an aqueous product on the first outer side.

18. Method for manufacturing a pad as claimed in claim 16, further comprising applying an agent for retarding absorption of an aqueous product on the first outer side.

19. Pad as claimed in claim 1 or 2, wherein the first outer side serves to cleanse skin by putting a make-up remover or cleansing lotion on said pad, with the striae initially acting as product storage areas and then serving to collect impurities, and the second outer side serving to absorb excess product and impurities.

* * * * *